United States Patent [19]

MacDougall

[11] 4,369,449

[45] Jan. 18, 1983

[54] LINEARLY POLARIZED OMNIDIRECTIONAL ANTENNA

[76] Inventor: James B. MacDougall, 236 E. Wood St., New Lenox, Ill. 60451

[21] Appl. No.: 268,846

[22] Filed: Jun. 1, 1981

[51] Int. Cl.[3] ..... H01Q 9/20

[52] U.S. Cl. ..... 343/790; 343/792

[58] Field of Search ..... 343/705, 708, 790, 791, 343/792, 853, 890

[56] References Cited

U.S. PATENT DOCUMENTS 3,159,838 12/1964 Facchine ..... 343/792

4,117,490 9/1978 Arnold et al. ..... 343/792

*Primary Examiner*—David K. Moore

*Attorney, Agent, or Firm*—Leydig, Voit, Osann, Mayer & Holt, Ltd.

[57] ABSTRACT

A linearly polarized omnidirectional antenna includes one or more dipoles having an elongated tubular conductive radiator of a length that is about half the wavelength of the midband frequency, and an elongated inner conductive member extending longitudinally through the interior of the radiator and spaced therefrom. A coaxial cable or other feed means conducts signals to and from one end of the radiator and to and from the inner conductive member. The impedances of the dipole and the feed means are matched over a selected frequency band, such as by the use of a series inductive reactance between the feed means and the radiator. Two such dipoles can be connected to a colinear, center-fed pair, and two or more such dipole pairs can be arranged in a colinear array having a common inner conductive member.

33 Claims, 16 Drawing Figures

LINEARLY POLARIZED OMNIDIRECTIONAL ANTENNA

DESCRIPTION OF THE INVENTION

The present invention relates to antennas, and specifically to linearly polarized omnidirectional antennas. Such antennas are commonly used in mobile radio and telephone communication systems, where the signals must be transmitted and received in a complete 360° circle around the antenna.

The central base stations for many radio communication systems use antennas of the type disclosed in U.S. Pat. No. 3,031,668, issued Apr. 24, 1962, to W. B. Bryson. This antenna is a series-fed sequence of end-fed, half-wavelength radiators which produce a combined radiation pattern in the shape of a flattened horizontal doughnut, resulting in substantial gain in radiated power at the peak of the beam. Connecting these multiple radiators in series results in rather severe frequency bandwidth limitations. Each successive radiator is separated from the source by an additional half-wavelength, but when the frequency changes, the radiators are no longer separated by a half-wavelength. The result is a cumulative change in phase which degrades the antenna performance because the impedances of the individual radiators no longer add in an optimal manner, and the peak of the beam tilts up and down with increasing and decreasing frequency, thereby decreasing the radiation intensity at the horizon. Consequently, the frequency bandwidth of this antenna is typically limited to about 3 percent of the mid-band frequency.

Regulatory agencies such as the FCC often allocate frequency bands containing different sub-bands for transmitting and receiving pairs, with each allocated band being approximately 3 percent of the mid-band frequency. Due to the aforementioned bandwidth limitations of presently available antennas, the antenna manufacturers produce a different antenna for each allocated sub-band. In some cases the regulatory agencies allocate transmit and receive frequency bands which are separated from each other, which means that two different antennas are presently used to transmit and receive.

Another method that has been used to form colinear arrays of radiators is to side mount either center-fed or loop dipoles off a common mast. The radiators are fed with a branched feed which eliminates beam tilting as a function of frequency. However, the cables and the mast of such antennas reflect energy which destroys the omnidirectional nature of the horizon pattern. The structure supporting these antennas must also be strong enough to support the additional wind loading of the mast.

It is a primary object of the present invention to provide an improved linearly polarized omnidirectional antenna which has a large bandwidth so that a single antenna can provide optimum performance over multiple sub-bands, even when these sub-bands are separated from each other by intervening sub-bands. In this connection, a related object is to provide such an improved antenna whose pattern does not tilt when the frequency is varied over the operating bandwidth.

It is another object of this invention to provide an improved linearly polarized omnidirectional antenna which can be made with an input impedance that matches that of its transmission line over a large bandwidth, thereby permitting highly efficient transfer of energy to and from the antenna.

A further object of the invention is to provide an improved antenna of the foregoing type which is capable of providing high gains.

It is still another object of the invention to provide such an improved linearly polarized omnidirectional antenna which can be readily stacked in a colinear array to further increase the gain while retaining the large bandwidth and good omnidirectional pattern.

Other objects and advantages of the invention will be apparent from the following detailed description and the accompanying drawings, in which:

FIG. 1 is a perspective view, partially in section, of a single-dipole antenna embodying the invention;

FIG. 1*a* is a graphical illustration of the radiation intensity produced along the length of the radiator element of the antenna of FIG. 1;

Figure 6:
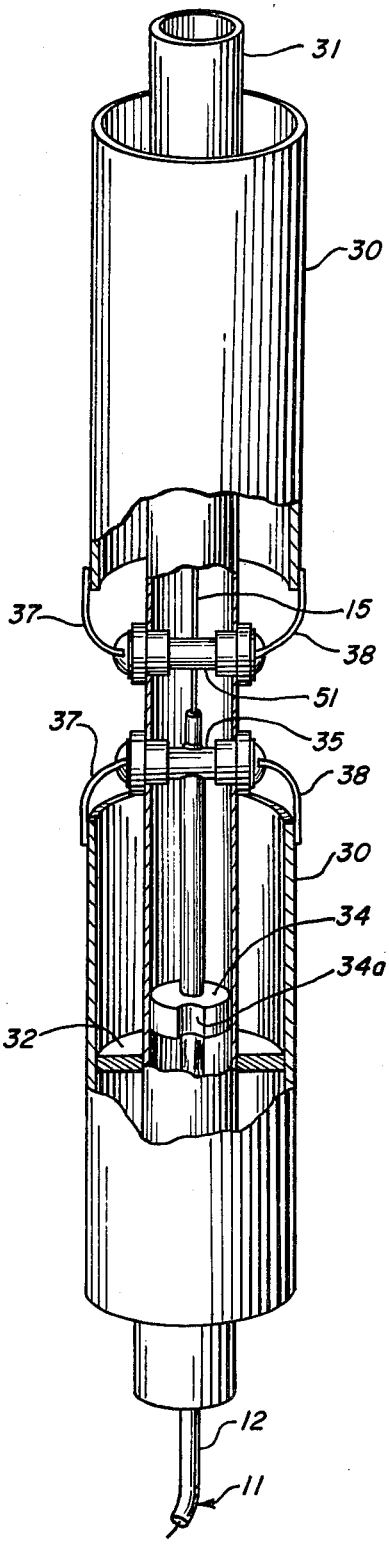
FIG. 6 is a perspective view, partially in section, of a center-fed dipole pair antenna embodying the invention.
Figure 6A:
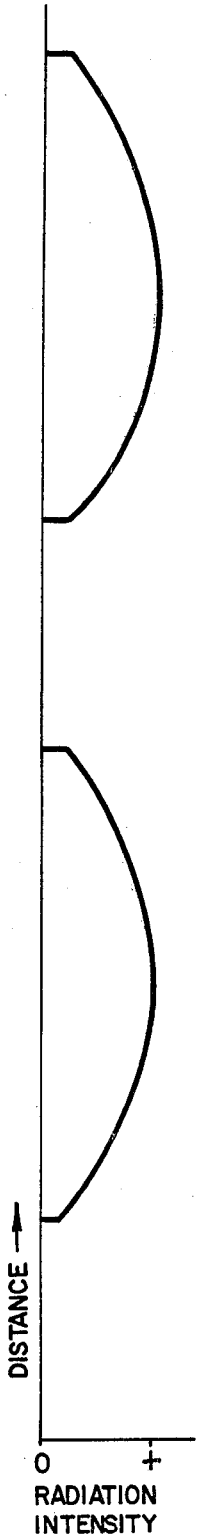
Figure 7:
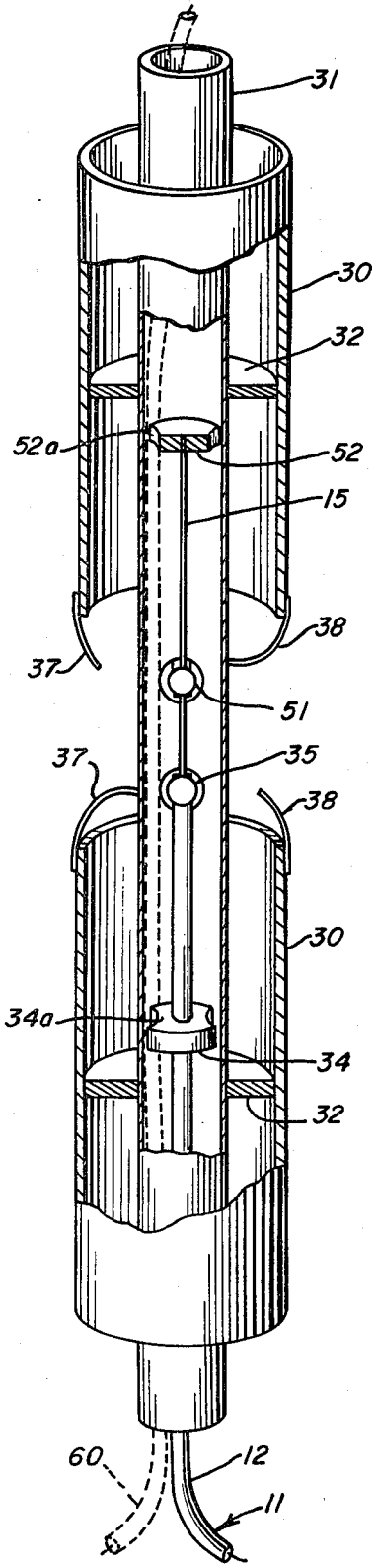
Figure 8:
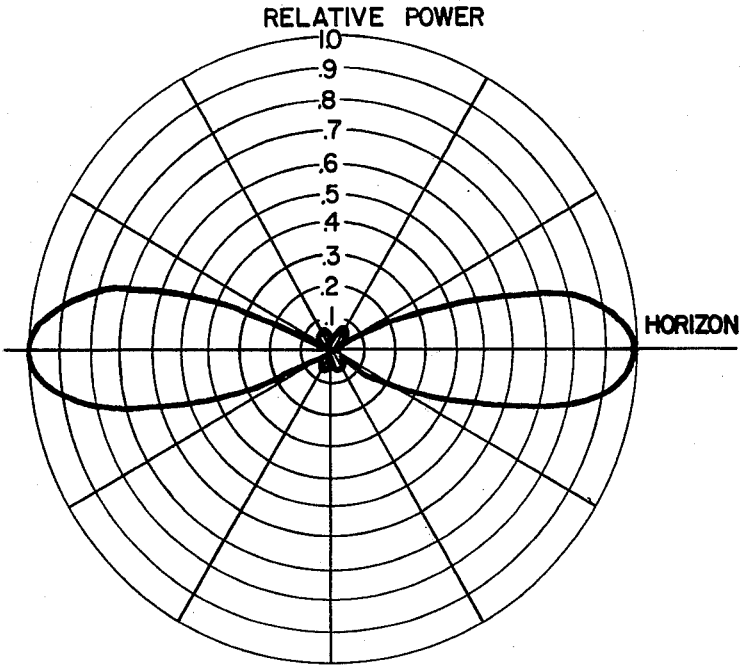
Figure 9A:
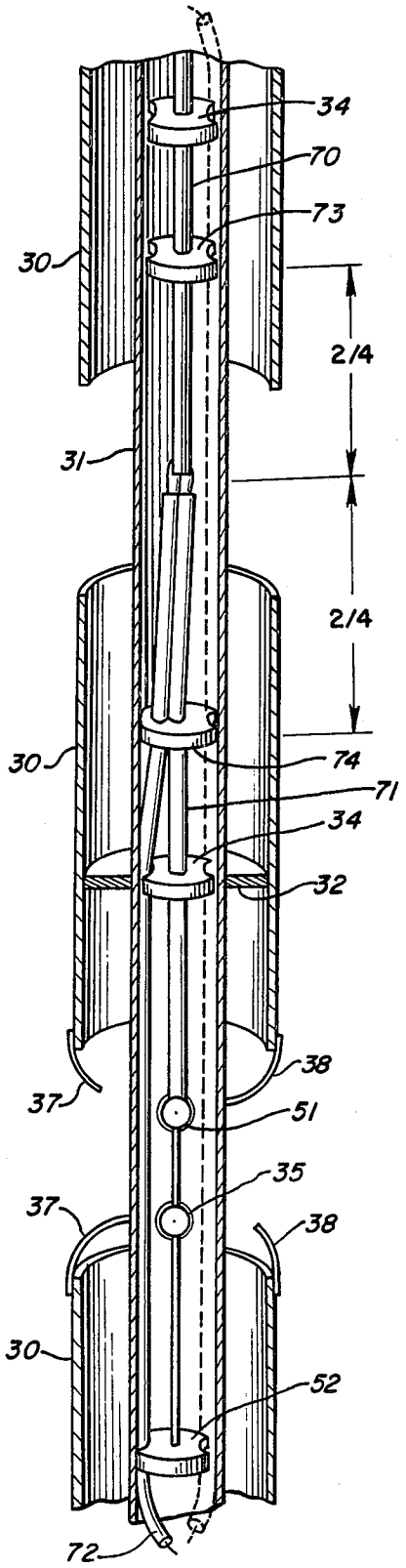
Figure 9:
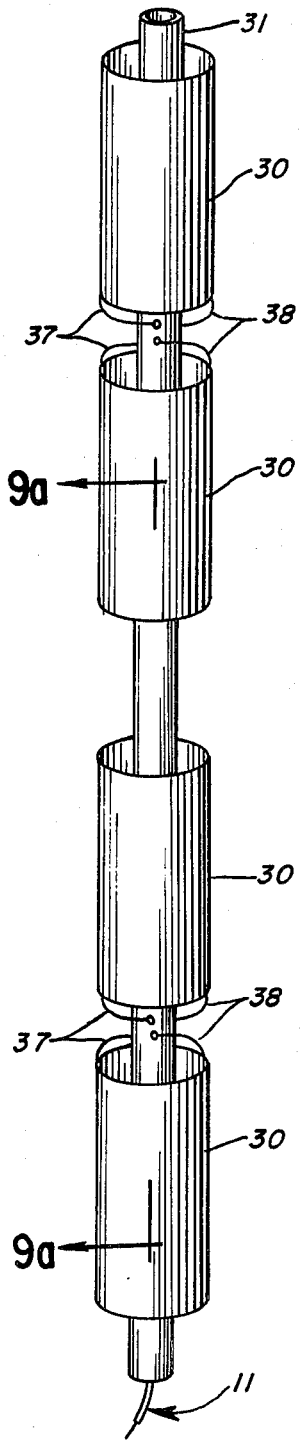
Figure 10:
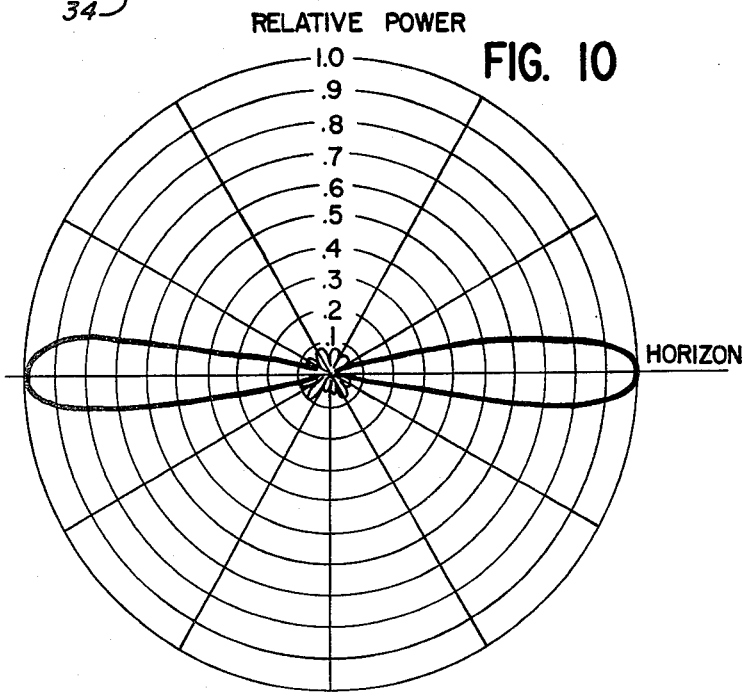

FIG. 6*a* is a graphical illustration of the radiation intensities produced along the lengths of the two radiator elements in the antenna of FIG. 6;

FIG. 7 is a perspective view, partially in section, of the same antenna shown in FIG. 6 but rotated 90° around its axis;

FIG. 8 is an illustration of a typical radiation pattern produced by the antenna of FIGS. 7 and 8;

FIG. 9 is a perspective view of an antenna formed by a colinear array of two of the dipole pairs of FIGS. 7 and 8;

FIG. 9*a* is an enlarged vertical section taken generally along line 9*a*—9*a* in FIG. 9;

FIG. 10 is an illustration of a typical radiation pattern produced by the antenna of FIGS. 9 and 9*a;*

Figure 11A:
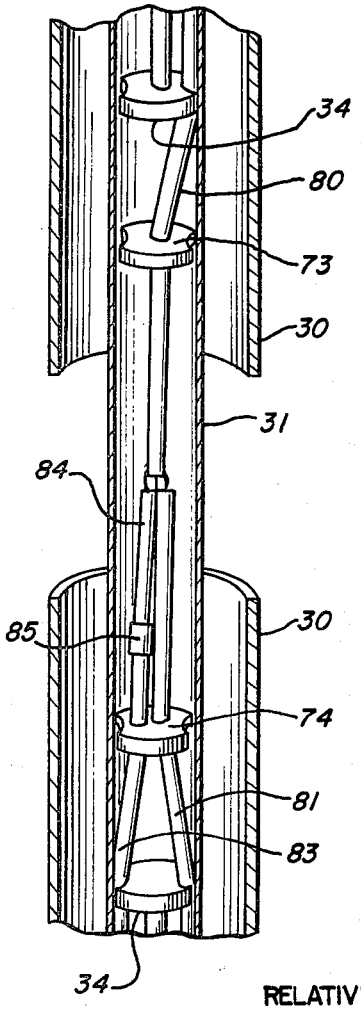
Figure 11:
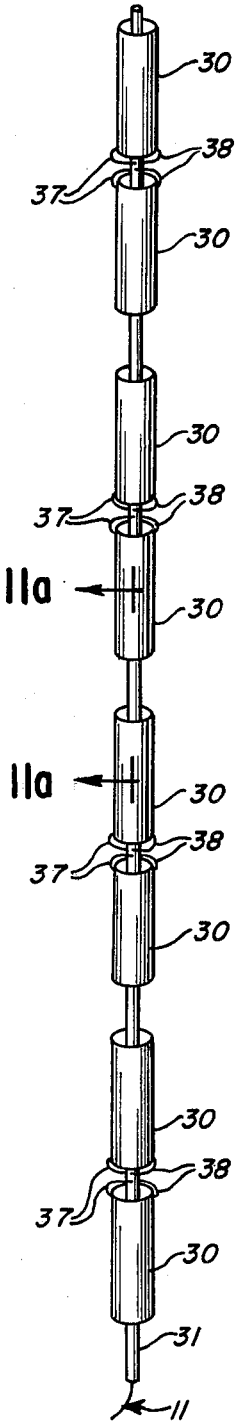
Figure 12:
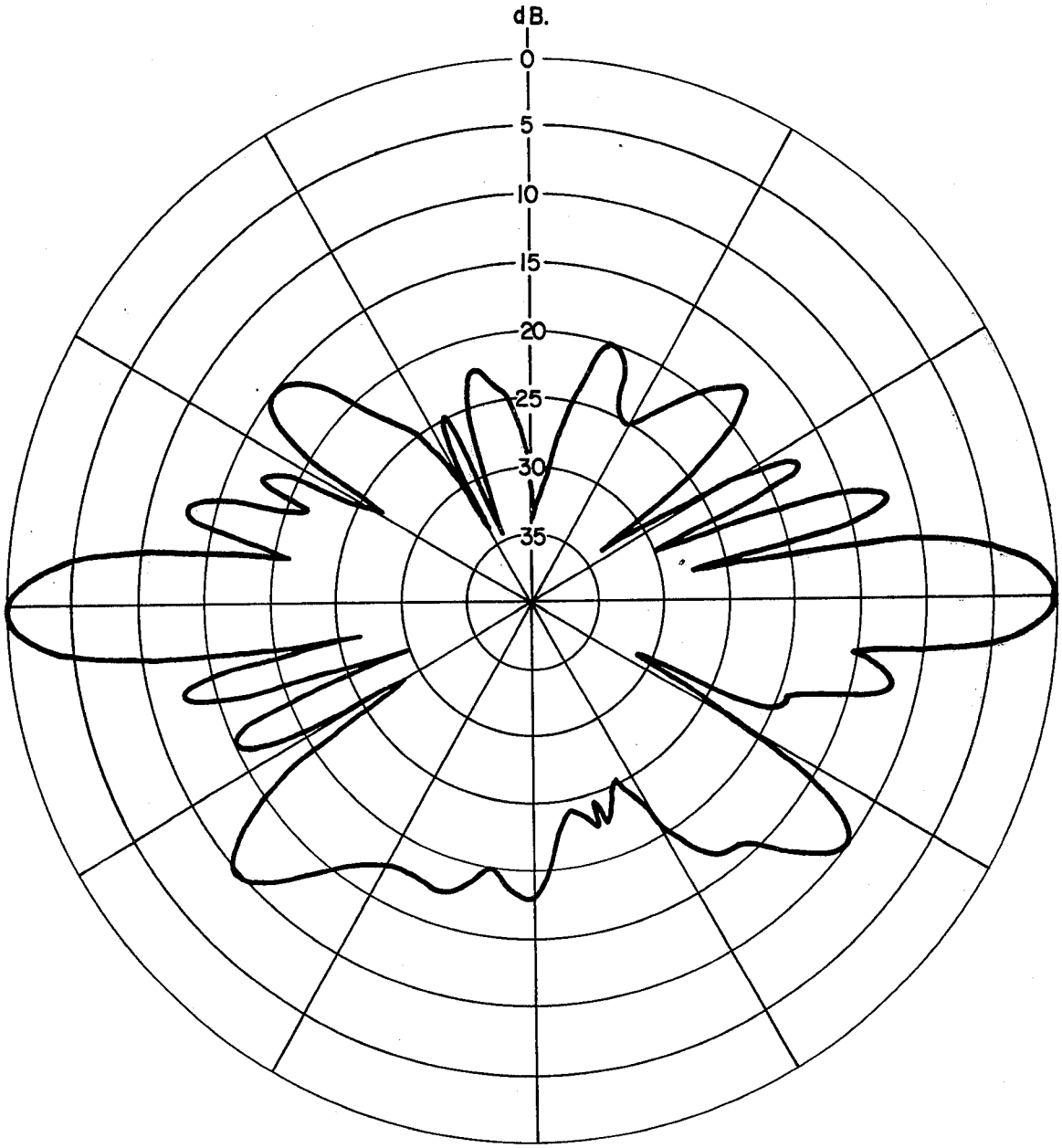

FIG. 11 is a perspective view of an antenna formed by a colinear array of four of the dipole pairs of FIGS. 7 and 8;

FIG. 11*a* is an enlarged vertical section taken generally along line 11*a*—11*a* in FIG. 11; and FIG. 12 is a typical measured radiation pattern produced by the antenna of FIGS. 11 and 11*a*.

While the invention has been shown and will be described in some detail with reference to specific exemplary embodiments of the invention, there is no intention that the invention be limited to such detail. On the contrary, it is intended to cover all modifications, alternatives and equivalents which may fall within the spirit and scope of the invention as defined in the appended claims.

Figure 1:
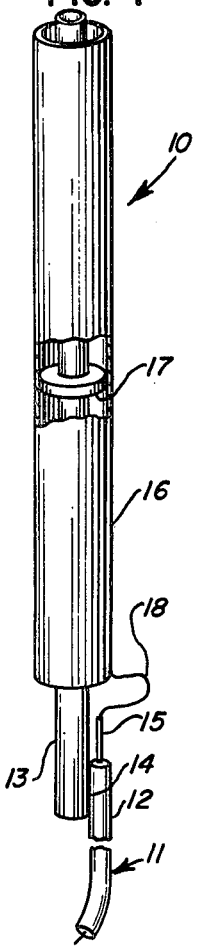

Turning now to the drawings and referring first to FIG. 1, there is shown a single half-wavelength dipole antenna 10 which is end-fed by a coaxial cable 11. (As used herein, the terms "feed" and "feed line" are intended to be bidirectional rather than unidirectional, referring to the transmission of signals both to and from the antenna.) The outer conductor 12 of the feed cable 11 is conductively connected to a conductive center rod 13, such as by a solder joint 14, and the inner conductor 15 of the cable 11 is connected to the radiating element of the antenna, which is a conductive tube 16 disposed concentrically around the rod 13. The tube 16 has a length equal to about one-half the wavelength of the mean frequency of the band of frequencies to be transmitted and received by the antenna, and the center rod 13 is long enough to extend beyond both ends of the radiating tube 16. The radiating tube 16 and the center rod 13 are continuously spaced apart and insulated from each other by a plurality of dielectric spacers 17. Although the rod 13 and the tube 16 are cylindrical in the illustrated embodiment, they can have other cross-sectional shapes such as square, oval, rectangular, etc.

Figure 1A:
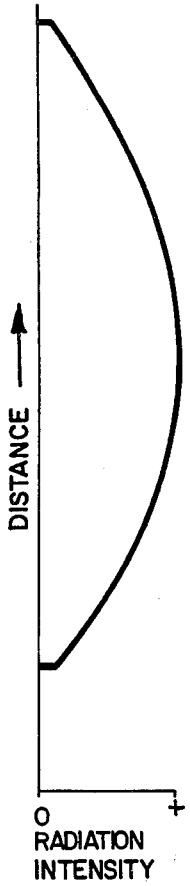

The intensity of the radiation produced along the length of the half-wavelength dipole antenna of FIG. 1 is illustrated in FIG. 1*a*. The radiation is produced with this same intensity around the entire circumference of the tube 16, thereby producing an omnidirectional pattern similar to that of a conventional center-fed half-wavelength skirt dipole.

In order to match the input impedance of the dipole to the impedance of the feed cable 11, over a selected operating frequency bandwidth, a series inductive reactance is connected between the feed cable 11 and the radiating tube 16. Thus, in the illustrative embodiment of FIG. 1, a wire 18 connecting the inner conductor 15 of the cable 11 to the radiating tube 16 forms a series inductive reactance which interacts with the reactance of the dipole to produce an antenna input impedance which matches the impedance of the coaxial cable 11 over the selected bandwidth. It has been found that this arrangement permits a single-dipole antenna to be designed to produced a good omnidirectional pattern and gain, comparable to those of a conventional center-fed half-wavelength dipole, over a relatively wide frequency band, preferably at least 5% of the midband frequency. Specific examples of these improved results will be illustrated by the working examples to be described below.

Figure 2:
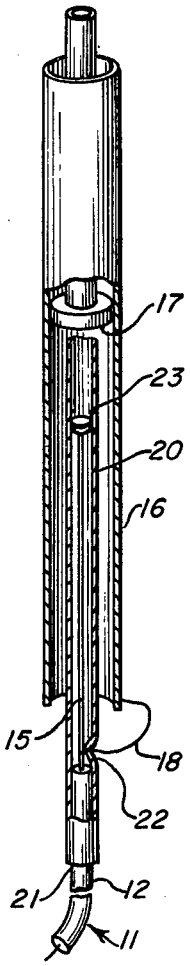
FIG. 2 is a perspective view, partially in section, of a modified single-dipole antenna embodying the invention.

In FIG. 2 there is illustrated a modification of the antenna of FIG. 1 in which the center rod 13 is replaced with a hollow tube 20 which fits over the end of the coaxial cable 11 (similar elements in the various figures are designated by the same reference numerals). The outer conductor 12 of the cable 11 is soldered to the end of the tube 20 at 21, and the inner conductor 15 of the cable is connected to the radiating tube 16 by a wire 18 passing through an aperture 22 in the tube 20. A conventional broad-banding network is formed by extending the inner conductor 15 of the cable 11 beyond the wire 19 by a distance of a quarter of a wavelength, and attaching the end of the inner conductor to a shorting disc 23 engaging the inside wall of the tube 20. This forms a resonant stub in parallel with the series-resonant antenna to maintain the impedance match between the antenna and the coaxial cable over an even wider frequency band. The same stub also forms a d-c. ground (e.g., for lightning) on the inner conductor of the cable.

The antenna of FIG. 2 produces linearly polarized omnidirectional patterns as good as those of conventional center-fed half-wavelength dipoles, but with significantly increased bandwidths. For example, an antenna having a bandwidth of 800 to 860 MHz. has been made using this design with a brass radiating tube of 0.5" outside diameter, 0.015" thickness and 6.5" length, a brass center tube of 5/32" outside diameter and 0.015" thickness, 1.35 inches of 22 gage wire as the wire 19 (228 ohms inductive reactance), and a 50-ohm coaxial cable as the feed cable.

Figure 3:
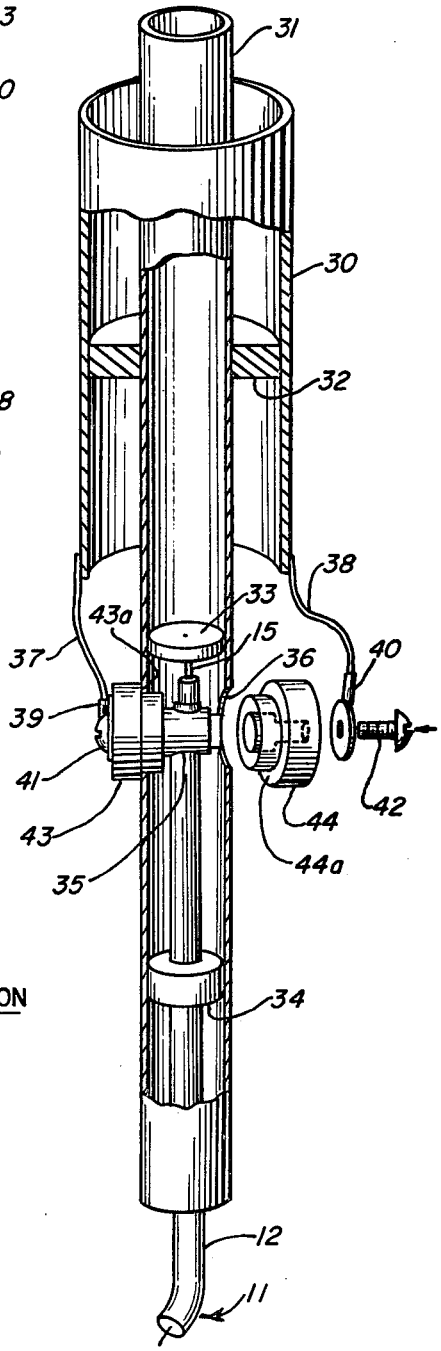
FIG. 3 is a perspective view, partially in section, of a further modified single-dipole antenna embodying the invention.

In the modified embodiment of FIG. 3, the radiating tube 30 has a much smaller length-to-diameter ratio. The center tube 31 also has a larger diameter, and is positioned concentrically within the radiating tube 30 by a dielectric spacer 32. The coaxial cable 11 is terminated inside the center tube 31, and the inner conductor 15 of the cable is connected to the tube 31 via shorting disc 33. A broad-banding network is formed by locating a shorting disc 34 between the outer conductor of the coaxial cable 11 and the center tube 31, one-quarter wavelength away from the point at which the outer conductor of the cable is connected to the radiating tube 30.

In order to connect the outer conductor 12 of the coaxial cable 11 to the radiating tube 30, a conductive feed post 35 is slipped over the end of the cable 11 and soldered to the outer conductor before the cable is inserted into the tube 31. Access to opposite ends of this feed post 35 is provided by a pair of diametrically opposed apertures 36 in the tube 31, and these apertures 36 are used to connect a pair of wires 37 and 38 to opposite ends of the feed post. The lower ends of the two wires 37 nd 38 are fastened to ring terminals 39 and 40, which are electrically connected to the ends of the feed post 35 via screws 41 and 42. To mechanically stabilize this feed arrangement while at the same time ensuring insulation between the feed elements and the center tube 31, a pair of insulators 43 and 44 are disposed between the ring terminals 39, 40 and the ends of the feed post 35. The inner ends of these insulators 43, 44 fit over complementary stubs formed on the ends of the feed post and seat against the shoulders formed by the main body portion of the feed post, and the outer portions of the insulators are enlarged to form shoulders 43*a* and 44*a* which seat against the outside surface of the center tube 31. Thus, when the screws 41 and 42 are tightened, the entire feed assembly is fastened solidly in position and locked to the center tube 31. By merely removing the screws 41 and 42 and withdrawing the two insulators 43 and 44, the coaxial cable and the feed post 35 can be easily moved longitudinally through the interior of the center tube 31.

The upper ends of these two wires 37 and 38 are soldered to the lower end of the tube 30 at diametrically opposite points. Splitting the wires in this manner facilitates attainment of the low input impedance needed to match the impedance of the feed cable 11. More specifically, separating the points at which the wires 37 and 38 are connected to the radiating tube 30 reduces the effective inductance, and thus reduces the input impedance of the antenna. This reduction is maximized by attaching the wires at points which are spaced symmetrically around the periphery of the lower end of the radiating tube 30, i.e., at diametrically opposite points in the embodiment illustrated in FIG. 3. For example, connecting the two wires at diametrically opposite points on the radiating tube 30 reduces the input impedance to about half of the impedance that would be attained by attaching the same two wires to a single point on the radiating tube.

In a working example of the antenna of FIG. 3 made with a brass radiating tube having a 2¼" outside diameter, a 0.015" thichness and a 6" length, and a brass center tube having a 0.75" outside diameter and a 0.015" thickness, the use of a single 22-gage wire with a length of 1.35" (in place of the two wires 37, 38) will provide an input impedance of 50 ohms to match the 50-ohm impedance of a typical feed cable. Using 16-gage wire with the two-wire arrangement illustrated in FIG., 3, two wires with a length of 1.25" each provide an input impedance of 25 ohms, which means that a center-fed pair of such antennas has a total input impedance of 50-ohms, again matching the impedance of the typical 50-ohm feed cable. With the use of a single wire, it would be impossible to achieve this low input impedance with radiators of large diameter, e.g., more than one tenth wavelength in diameter, and even with smaller diameter radiators the required wire length would be so short that manufacturing tolerances would become critical.

Figure 4:
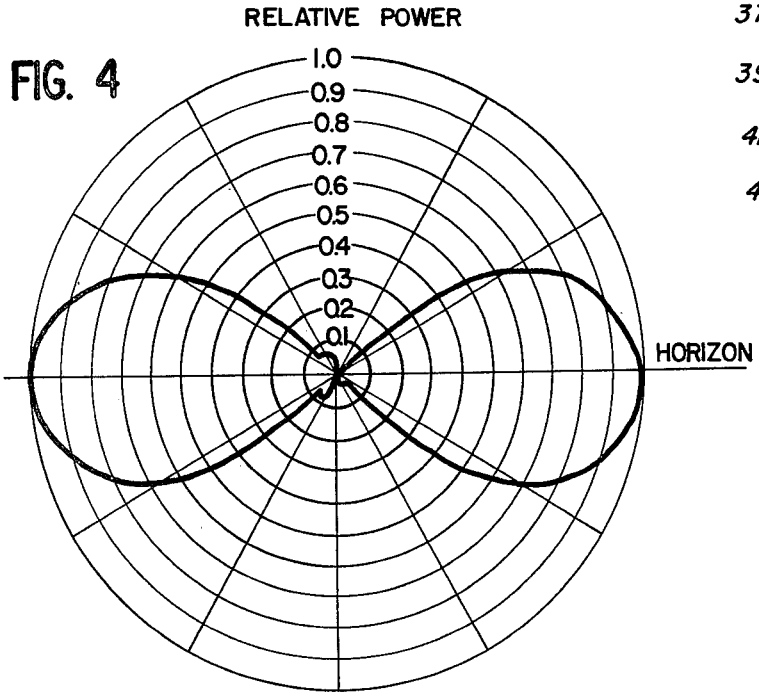
FIG. 4 is an illustration of a typical radiation pattern produced by the antenna of FIG. 3.

The antenna described above has been tested and found to produce linearly polarized omnidirectional patterns as good as those of conventional center-fed half-wavelength dipoles, but with significantly increased bandwidths (e.g., bandwidths of 20% centered at 850 MHz, VSWR of less than 1.5:1 across the frequency band). These tests were conducted with the antenna inside a 3"-diameter cylindrical radome of 0.25"-thick polyester fiberglass. The patterns obtained with this antenna are exemplified by the pattern illustrated in FIG. 4, which shows a half-power beamwidth of 74°.

Figure 5:
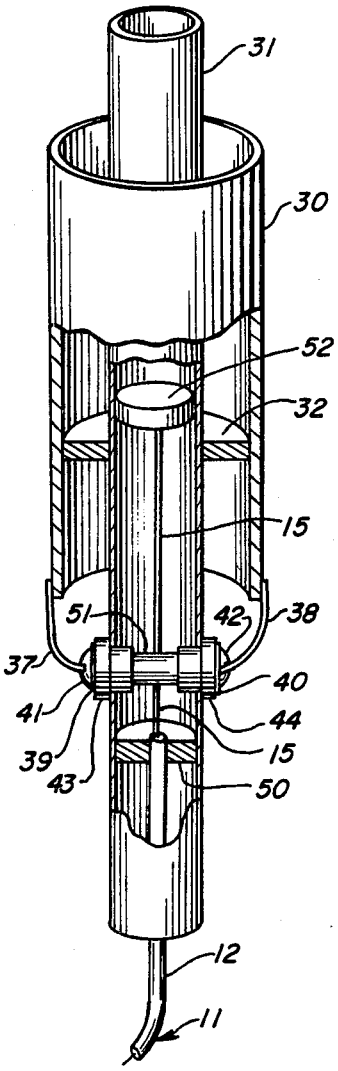
FIG. 5 is a perspective view of yet another modified single-dipole antenna embodying the invention.

Turning next to FIG. 5, the antenna shown here is similar to the antenna of FIG. 3 except that a feed post 51 is soldered to the inner conductor 15 of the coaxial cable 11, rather than the outer conductor; the outer conductor 12 is connected to the center tube 31 by means of a shorting disc 50; and the broad-banding network is formed by extending the inner conductor 15 upwardly within the tube 31 by a distance equal to one quarter wavelength from the point of connection to the feed post 51, and connecting the end of the inner conductor to the inside walls of the tube 31 with a shorting disc 52.

In tests conducted with the antenna of FIG. 5, using the same materials and dimensions described above for the antenna of FIG. 3, and without the broad-banding network formed by the extension of the inner conductor 15 and the shorting disc 52, the antenna produced linearly polarized omnidirectional patterns as good as those of conventional center-fed half-wavelength dipoles, but with significantly increased bandwidths (e.g., bandwidths of 10% centered at 850 MHz).

In FIGS. 6 and 7 there is shown a center-fed dipole pair in which the upper dipole is essentially the same as the antenna shown in FIG. 5 (minus the connection to the outer conductor of the coaxial feed cable 11) and the lower dipole is essentially the same as the antenna shown in FIG. 3 (with the radiating tube 30 inverted, and minus the connection to the inner conductor of the cable 11). The center tube 31 is a common ground to the two radiator sleeves 30. With this center-feed arrangement, the signals fed to the two radiators are 180° out of phase with each other, but this phase difference is counterbalanced by the inverted positions of the two radiators relative to each other. Consequently, the radiation from the two radiators is of the same polarity, as illustrated in FIG. 6*a*. The gain of this center-fed pair is, typically 3 dB, i.e., twice that of the single half-wavelength antennas of FIGS. 3 and 5, and also twice the gain of a conventional center-fed half-wavelength dipole antenna. Because of the center feed, the antenna pair of FIGS. 6 and 7 does not produce any beam tilt.

Another feature of the antenna illustrated in FIGS. 6 and 7 is the capability of routing additional cables, e.g., for additional dipole pairs or auxiliary antenna devices, longitudinally through the interior of the center tube 31. Thus, the shorting discs 34 and 52 inside the tube 31 are notched at 34*a* and 52*a* to permit a second cable 60 (illustrated in broken lines in FIG. 7) to pass longitudinally through the tube 31. To pass additional cables, additional notches are simply formed in the shorting discs. It has been found that the number of cables passing through the tube 31 has no effect on the radiation characteristics of the antenna, and only a negligible effect on the characteristic impedance of the broad-banding networks.

The antenna of FIGS. 6 and 7 produces good linearly polarized omnidirectional patterns with 3 dB gains and extremely wide bandwidths. For example, such an antenna made with wires 37 and 38 1.75" long (16 gage wire) and using a quarter wavelength transformer to match the resulting 100-ohm input impedance to the 50-ohm impedance of the feed cable, and otherwise using the same materials and dimensions described above for the antenna of FIG. 3 (for each of the two radiators), and the same radome, produced a 3 dB gain (with reference to a center-fed half-wavelength dipole antenna), and a VSWR of less than 1.5:1 across a frequency band of 725 MHz to 977 MHz, which is almost a 30% bandwidth. Moreover, the beam did not tilt with frequency variations within the operating bandwidth. The patterns obtained with this antenna are exemplified by the pattern illustrated in FIG. 8, which shows a half-power beamwidth of 40°. This performance encompasses an entire group of frequencies recently allocated by the FCC.

In FIGS. 9 and 9*a*, there is illustrated a colinear array of two of the dipole pairs shown in FIGS. 6 and 7. A single inside tube 31 is common to all the radiators, and each dipole pair is center-fed by a separate coaxial cable extending longitudinally through the interior of the tube 31. Although only two dipole pairs have been illustrated in the colinear array of FIGS. 9 and 9*a*, it will be appreciated that any number of these dipole pairs may be added to the colinear array. Indeed, in the particular embodiment illustrated in FIG. 9*a*, the various shorting discs inside the tube 31 are provided with two notches or apertures to accommodate the longitudinal passage of not only the second coaxial cable for feeding the second dipole pair, but also a third coaxial cable (illustrated in broken lines in FIG. 9*a*) for feeding a third dipole pair (not shown).

In a working example of this multi-pair array, the cables 70 and 71 feeding the two dipole pairs are 100-ohm coaxial cables rather than the 50-ohm cable referred to above in the descriptions of FIGS. 1–7. These two 100-ohm cables 70 and 71 are fed by a single 50-ohm cable 72. In order to connect the 50-ohm cable to the two feed cables 70 and 71 in a parallel, and therefore impedance-matched, manner, the inner conductor of the cable 72 is soldered to the outer conductor of the cable 70, which in turn is also soldered to the inner conductor of the cable 71; and the outer conductor of the calbe 72 is soldered to both the inner conductor of the cable 70 and the outer conductor of the cable 71. As can be seen in FIG. 9*a*, these connections are made at a point between the two dipole pairs and midway between two balun shorting discs 73 and 74 each of which is located a quarter wavelength away from the solder connections. With this combiner configuration, the signals in the two cables 70 and 71 are 180° out of phase, and this phase difference is counterbalanced by inverting the two dipole pairs with respect to each other. More specifically, the upper dipole pair is identical to the pair illustrated in FIGS. 6 and 7, while the lower dipole pair is of the same construction but inverted, i.e., turned 180°. Consequently, the resulting radiation from all of the individual radiators is of the same polarity.

The antenna of FIGS. 9 and 9*a* is characterized by the combination of a large bandwidth (e.g., in excess of 17%) and a high gain (e.g., 6 dB over a conventional center-fed half-wave dipole) while producing a good omnidirectional pattern which does not tilt with frequency variations within the operating bandwidth. For example, such an antenna made with the same materials and dimensions described above with respect to FIG. 3 (but with 1.75" wires to provide a 100-ohm input impedance to match the cable) has produced a 6 dB gain and a VSWR of less than 1.5:1 across a frequency band of 796 to 952 MHz with a stable omnidirectional pattern having a half power beamwidth of about 20°. The patterns obtained with this antenna are exemplified by the pattern illustrated in FIG. 10, which is typical of the patterns measured for this antenna across the entire frequency band of 796 to 952 MHz.

Turning next to FIGS. 11 and 11*a*, there is illustrated an antenna comprising a colinear array of four dipole pairs of the type shown in FIGS. 6 and 7. In this embodiment the cables which directly feed the various radiators are again 100-ohm cables, and they are fed by a pair of 50-ohm cables 80 and 81. These two 50-ohm cables are in turn fed by a third 50-ohm cable 83. Because the two 50-ohm cables 80 and 81 are in parallel with each other, they present a 25-ohm input impedance to the 50-ohm feed cable 83. To match this input impedance, a conventional quarter-wave transformer is formed at the end of the cable 83 by splicing it to a length of 35-ohm cable 84 which is a quarter wavelength long (35 ohms is the square root of (25 ohms$\times$50 ohms), which is the conventional equation for determining the impedance of this type of quarter-wavelength transformer). The splice between the cables 83 and 84 is formed by soldering the two inner conductors to each other and soldering a short sleeve 85 to both outer conductors.

A typical pattern produced by the antenna of FIGS. 11 and 11*a* using the same materials and dimensions described above in connection with FIG. 3, is illustrated in FIG. 12. The performance of this antenna is similar to that described above for the antenna of FIGS. 9 and 9*a*, except that the gain is 9 dB over a conventional center-fed half-wavelength dipole, instead of 6 dB.

While the various arrays described above were designed to maximize antenna gain, it should be appreciated that the antenna performance required in certain applications might dictate a design that "trades off" a certain amount of gain for other desired characteristics. For example, the arrays can be designed to utilize different phases and/or different power levels in the various individual radiators. Thus, an antenna designed for inter-satellite communication might require a tilted beam (independent of frequency variations across the operating bandwidth), which can be achieved by using wires of different lengths to vary the phase of the signals supplied to different radiators; the inductance of such wires can be held constant by using wires of different thicknesses. As another example, the bandwidth of a given array might be extended by designing different radiators for different but overlapping frequency bands, either by using wires of different inductances or by using radiating tubes of different lengths; this design would sacrifice a certain amount of gain for an increase in bandwidth. Wires providing different amounts of inductance to each of the two radiators change the relative power division therebetween while still matching the impedance of the feed means. Thus, the amplitude and phase of each radiator can be controlled, thereby allowing great versatility in antenna array design.

As can be seen from the foregoing detailed description, the present invention provides an improved linearly polarized omnidirectional antenna which has a large bandwidth so that a single antenna can provide optimum performance over multiple sub-bands, even when these sub-bands are separated from each other by intervening sub-bands. The pattern produced by this antenna does not tilt when the frequency is varied over the operating bandwidth, and the antenna is capable of providing high gains. The dipoles provided by this invention can be readily stacked in colinear arrays to further increase the gain while retaining the large bandwidth and good omnidirectional pattern.

I claim as my invention:

1. A linearly polarized omnidirectional antenna for transmitting and receiving radio signals within a selected frequency band, said antenna comprising an elongated tubular conductive radiator, an elongated inner conductive member extending longitudinally through the interior of said radiator and electrically spaced away from said radiator along the entire length of said radiator, feed means for conducting signals to and from one end of said radiator and to and from said inner conductive member, and a series reactive impedance between said feed means and said radiator, the combined impedance of said radiator, said inner conductive member and said series reactive impedance substantially matching the impedance of said feed means over said selected frequency band.

2. A linearly polarized omnidirectional antenna as set forth in claim 1 in which said feed means comprises a transmission line.

3. A linearly polarized omnidirectional antenna as set forth in claim 1 wherein said feed means comprises a coaxial cable having concentric conductors one of which is connected to the end of said radiator, and the other of which is connected to said inner conductive member.

4. A linearly polarized omnidirectional antenna as set forth in claim 3 wherein the inner conductor of said coaxial cable is connected to said radiator via said series reactive impedance, and the outer conductor of said coaxial cable is connected to said inner conductive member.

5. A linearly polarized omnidirectional antenna as set forth in claim 3 wherein the outer conductor of said coaxial cable is connected to said radiator via said series reactive impedance, and the inner conductor of said coaxial cable is connected to said inner conductive member.

6. A linearly polarized omnidirectional antenna as set forth in claim 1 wherein said series reactive impedance is an inductive reactance provided by a wire connecting said feed means and said radiator.

7. A linearly polarized omnidirectional antenna as set forth in claim 6 wherein said series inductive reactance is provided by two or more wires connecting said feed means and said radiator, said wires being connected to said radiator at two or more points spaced around the periphery of the end of the radiator.

8. A linearly polarized omnidirectional antenna as set forth in claim 7 wherein all the wires connected to the same radiator have substantially identical inductive reactances.

9. A linearly polarized omnidirectional antenna as set forth in claim 7 wherein the points at which said wires are connected to said radiator are spaced symmetrically with respect to the periphery of said radiator.

10. A linearly polarized omnidirectional antenna as set forth in claim 1 wherein said inner conductive member is a tube.

11. A linearly polarized omnidirectional antenna as set forth in claim 1 wherein said inner conductive member is a tube, and means for feeding a second device is disposed within the interior of said tube.

12. A linearly polarized omnidirectional antenna as set forth in claim 1 which includes a broad-banding network connected to the end of said feed means, and the combined impedance of said radiator, said inner conductive member, said series reactive impedance and said broad-banding network substantially matches the impedance of said feed means over said selected frequency band.

13. A linearly polarized omnidirectional antenna as set forth in claim 12 wherein said feed means comprises a coaxial cable, and said broad-banding network comprises a resonant stub connected to the end of said coaxial cable.

14. A linearly polarized omnidirectional antenna as set forth in claim 13 wherein said inner conductive member comprises a tube surrounding the end of said coaxial cable and said resonant stub.

15. A linearly polarized omnidirectional antenna for transmitting and receiving radio signals within a selected frequency band, said antenna comprising a dipole having an elongated tubular conductive radiator, and an elongated inner conductive member extending longitudinally through the interior of said radiator and electrically spaced away from said radiator along the entire length of said radiator, feed means for conducting signals to and from one end of said radiator and to and from said inner conductive member, and means for matching the impedances of said dipole and said feed means over said selected frequency band.

16. A linearly polarized omnidirectional antenna as set forth in claim 15 wherein said frequency band is at least 5% of the midband frequency.

17. A linearly polarized omnidirectional antenna for transmitting and receiving radio signals within a selected frequency band, said antenna comprising a pair of elongated colinear tubular conductive radiators spaced apart from each other in the longitudinal direction, an elongated inner conductive member extending longitudinally through the interiors of said radiators and electrically spaced away from said radiators along the entire lengths of said radiators, said inner conductive member forming a common ground to said radiators, feed means for conducting signals to and from the adjacent ends of said radiators, and a series reactive impedance between said feed means and each of said radiators, the combined impedance of said radiators, said inner conductive member and said series reactive impedance substantially matching the impedance of said feed means.

18. A linearly polarized omnidirectional antenna as set forth in claim 17 wherein said feed means is a coaxial cable having an inner conductor connected to one of said radiators and an outer conductor connected to the other of said radiators.

19. A linearly polarized omnidirectional antenna as set forth in claim 17 wherein each of said series reactive impedances is an inductive reactance provided by a wire connecting said feed means and said radiator.

20. A linearly polarized omnidirectional antenna as set forth in claim 19 wherein at least one of said series inductive reactances is provided by two or more wires connecting said feed means and said radiator, said wires being connected to said radiator at two or more points spaced around the periphery of the end of the radiator.

21. A linearly polarized omnidirectional antenna as set forth in claim 20 wherein all the wires connected to the same radiator have substantially identical inductive reactances.

22. A linearly polarized omnidirectional antenna as set forth in claim 20 wherein the points at which said wires are connected to said radiator are spaced symmetrically with respect to the periphery of said radiator.

23. A linearly polarized omnidirectional antenna as set forth in claim 17 wherein said inner conductive member is a tube.

24. A linearly polarized omnidirectional antenna as set forth in claim 17 wherein said inner conductive member is a tube, and means for feeding a second device is disposed within the interior of said tube.

25. A linearly polarized omnidirectional antenna as set forth in claim 17 which includes a broad-banding network connected to the end of said feed means, and the combined impedance of said radiator, said inner conductive member, said series reactive impedance and said broad-banding network substantially matches the impedance of said feed means over said selected frequency band.

26. A linearly polarized omnidirectional antenna as set forth in claim 25 wherein said feed means comprises a coaxial cable, and said broad-banding network comprises a resonant stub connected to the end of said coaxial cable.

27. A linearly polarized omnidirectional antenna as set forth in claim 26 wherein said inner conductive member comprises a tube surrounding the end of said coaxial cable and said resonant stub.

28. A linearly polarized omnidirectional antenna comprising a colinear array of a plurality of antennas as set forth in claim 16 wherein said elongated inner conductive member is common to all the antennas and comprises a tube, and said feed means for each of said antennas passes through a portion of the interior of said tube.

29. A linearly polarized omnidirectional antenna as set forth in claim 17 wherein said radiators are substantially equal in length.

30. A linearly polarized omnidirectional antenna as set forth in claim 17 wherein said feed means supplies the two radiators with signals that are 180° out of phase.

31. A linearly polarized omnidirectional antenna for transmitting and receiving radio signals within a selected frequency band, said antenna comprising a pair of colinear dipoles each having an elongated tubular conductive radiator, and an elongated inner conductive member extending longitudinally through the interiors of said radiators and electrically spaced away therefrom along the entire lengths of said radiators, said radiators being spaced apart in the longitudinal direction, and said inner conductive member forming a common ground, feed means for conducting signals to and from the adjacent ends of said radiators, and means for matching the impedance of each of said dipoles to the impedance of said feed means over said selected frequency band.

32. A linearly polarized omnidirectional antenna as set forth in claim 31 wherein said frequency band is at least 5% of the midband frequency.

33. A linearly polarized omnidirectional antenna comprising a colinear array of a plurality of antennas as set forth in claim 31 wherein said elongated inner conductive member is common to all the antennas and comprises a tube, and said feed means for each of said antennas passes through a portion of the interior of said tube.

* * * * *